United States Patent [19]

Ohno

[11] 4,416,419

[45] Nov. 22, 1983

[54] RAILWAY BED

[76] Inventor: Ietatsu Ohno, 1-2, 1-chome, Kasuya, Setagaya-ku, Tokyo, Japan

[21] Appl. No.: 286,673

[22] Filed: Jul. 24, 1981

Related U.S. Application Data

[63] Continuation of Ser. No. 71,718, Aug. 31, 1979, abandoned.

[30] Foreign Application Priority Data

Aug. 31, 1978 [JP] Japan ..... 53-106511
Feb. 15, 1979 [JP] Japan ..... 54-16503

[51] Int. Cl.[3] ..... E01B 3/46
[52] U.S. Cl. ..... 238/89; 238/84; 238/85; 238/382
[58] Field of Search ..... 238/2, 5, 6, 7, 83, 238/84, 85, 89, 283, 382

[56] References Cited

U.S. PATENT DOCUMENTS

| | | | |
|---|---|---|---|
| 1,028,828 | 6/1912 | Paul | 238/89 |
| 1,115,225 | 10/1914 | McKenzie | 238/89 |
| 3,893,619 | 7/1975 | Bruner | 238/83 |
| 4,079,889 | 3/1978 | Halpenny | 238/84 X |

FOREIGN PATENT DOCUMENTS

| | | | |
|---|---|---|---|
| 2216367 | 12/1972 | Fed. Rep. of Germany | 238/85 |
| 427122 | 7/1911 | France | 238/89 |

*Primary Examiner*—Randolph Reese
*Attorney, Agent, or Firm*—Laurence R. Brown

[57] ABSTRACT

A railway bed wherein a body on which rails are to be fitted is formed of an elastic member and rigid member and a reinforcing member is provided within the elastic member or at least on the lower surface of the rigid member.

With such formation, the railway bed has a proper shock absorption and rigidity and can be expected to prevent vibrations and noises.

1 Claim, 8 Drawing Figures

FIG. 1A
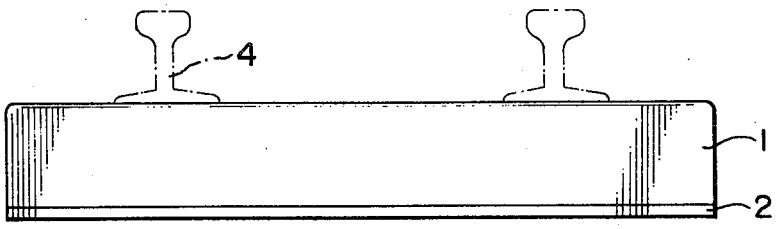
FIG. 1B
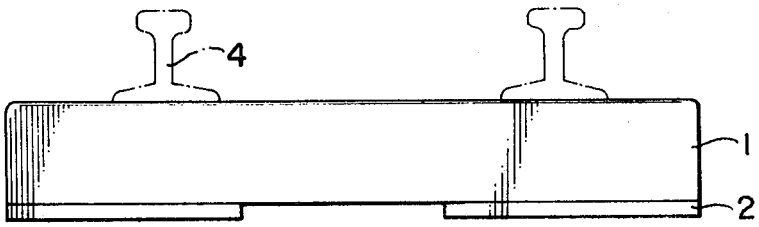
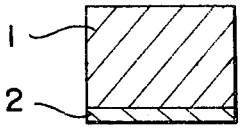
FIG. 2
FIG. 3
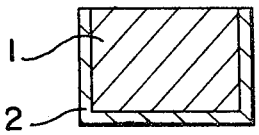
FIG. 4
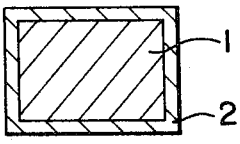

RAILWAY BED

This application is a continuation of application Ser. No. 071,718, filed Aug. 31, 1979 now abandoned.

BACKGROUND OF THE INVENTION

1. Field of the Invention

This invention relates to railway beds on which railway rails are to be fitted.

2. Description of the Prior Art

Railway ties are required to have a proper rigidity and vibration absorption. A railway has been provided by using wood or concrete blocks and gravel ballast. Yet metallic noises issued when railway cars run are transmitted to railways, elevated roads and railway structures through ties from rails to cause significant noise pollution.

SUMMARY OF THE INVENTION

An object of the present invention is to provide a railway bed which eliminates such defects as are mentioned above and has a proper rigidity and shock absorption.

The railway bed according to the present invention is characterized in that an elastic member and rigid member are provided between a rail and ground surface.

Further objects, advantages and features of the present invention will become more fully apparent from a detailed consideration of the arrangement and construction of the constituent parts as set forth in the following specification taken together with the accompanying drawing.

BRIEF DESCRIPTION OF THE DRAWINGS

In the drawings,

FIG. 1A is an elevation showing an embodiment of the railway bed of the present invention.

FIG. 1B is an elevation showing another embodiment.

FIG. 2 is a vertically sectioned view of FIGS. 1A and 1B.

FIGS. 3 and 4 are vertically sectioned views of further embodiments.

DETAILED DESCRIPTION OF THE PREFERRED EMBODIMENTS

Figure 5:
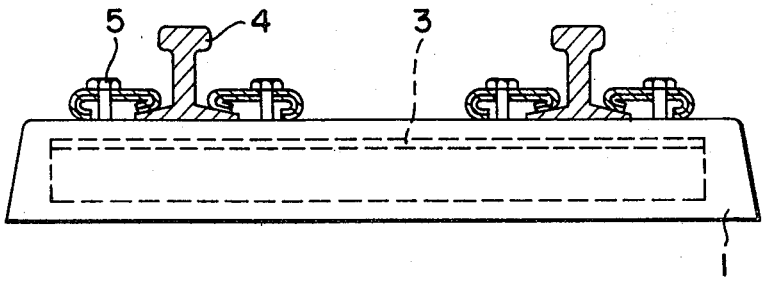
FIG. 5 is an elevation of still another embodiment of the railway bed of the present invention.

In the drawings, 1 is a wood body impregnated with an antiseptic to prevent it from being corroded by rainwater or the like and fitted on one surface, that is, the lower surface of four surfaces in the lengthwise direction with an elastic member 2 made of a hard rubber material or synthetic resin material of a proper thickness to have a proper rigidity and shock absorption. This elastic material 2 may be fitted to a part of the lower surface of the body 1 as in FIG. 1B. By the way, in this embodiment, the elastic member 2 is fitted to only the lower surface of the wood body 1. However, the elastic member 2 may be fitted to the three surfaces including the lower surface and both side surfaces as shown in FIG. 3 or over all the surfaces as shown in FIG. 4. It may be also fitted to both side surfaces. It is needless to say that a concrete block body may be used instead of such wood body 1.

Figure 6:
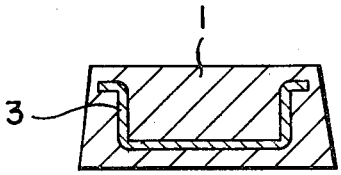
FIG. 6 is a vertically sectioned view of FIG. 5.
Figure 7:
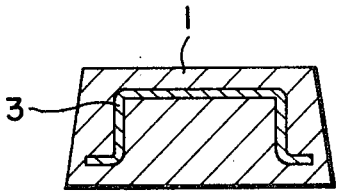
FIG. 7 is a vertically sectioned view of still another embodiment.

Now, in the embodiments shown in FIGS. 5 to 7, the body 1 is formed of a hard rubber or synthetic resin material and a U-shaped steel member 3 is integrally molded in the lengthwise direction of the body 1 within it. By the way, rails 4 are fitted by embedding fasteners for fitting bolts 5 in advance or by any other proper means . The bolt 5 as shown in FIG. 5 extends into the body 1 between the open arms of the U-shaped steel member 3 and toward the bottom thereof. The U-shaped steel member 3 comprises a single piece extending between and beyond the rails 4, and is separated by the plastic body 1 from metallic contact with the rails 4.

As the present invention is of such formation, the vibrations of cars will be properly reduced by the combination of the shock absorption by the elastic member and the rigidity of the rigid member. Therefore, the present invention is very effective to the noise prevention and mass production.

While the present invention has been described with reference to particular embodiments thereof, it will be understood that numerous modifications may be made by those skilled in the art without actually departing from the spirit and scope of the invention as defined in the appended claims.

I claim:

1. A railway bed adapted for reducing vibration pollution comprising an elastic member of a material from the class consisting of hard rubber and synthetic resins forming a tie extending longitudinally between and beyond the rails and located between the rails and ground surface, wherein a pair of rails is fitted on said elastic member, a single U-shaped reinforcing steel rigid member integrally molded in the lengthwise direction fully within said elastic member and separated thereby from metallic contact with the rails, said single member having a length to extend between and beyond the rails, thereby to reduce the vibrations of rail cars by shock absorption by the interacting combination of rails, the elastic member, the rigidity of the rigid member and rail fastening means, said rail fastening means comprising a bolt or the like for mounting the rails directly on the elastic material embedded in said elastic material to extend between the open arms of the U-shaped member and toward the bottom thereof.

* * * * *